US011466472B2

(12) United States Patent
Lee

(10) Patent No.: US 11,466,472 B2
(45) Date of Patent: Oct. 11, 2022

(54) TELESCOPIC MAST

(71) Applicant: Jong Hee Lee, Seoul (KR)

(72) Inventor: Jong Hee Lee, Seoul (KR)

( * ) Notice: Subject to any disclaimer, the term of this patent is extended or adjusted under 35 U.S.C. 154(b) by 0 days.

(21) Appl. No.: 17/600,484

(22) PCT Filed: May 4, 2020

(86) PCT No.: PCT/KR2020/005882
§ 371 (c)(1),
(2) Date: Sep. 30, 2021

(87) PCT Pub. No.: WO2020/235832
PCT Pub. Date: Nov. 26, 2020

(65) Prior Publication Data

US 2022/0205266 A1 Jun. 30, 2022

(30) Foreign Application Priority Data

May 23, 2019 (KR) ..... 10-2019-0060738

(51) Int. Cl.
*E04H 12/18* (2006.01)
*E04H 12/02* (2006.01)
(Continued)

(52) U.S. Cl.
CPC ..... *E04H 12/182* (2013.01); *E04H 12/02* (2013.01); *F21V 21/22* (2013.01); *H01Q 1/10* (2013.01); *Y10T 428/1362* (2015.01)

(58) Field of Classification Search
CPC ..... E04H 12/182; E04H 12/02; F21V 21/22; B60Q 1/2657; H01Q 1/10; Y10T 428/1362
(Continued)

(56) References Cited

U.S. PATENT DOCUMENTS 2,666,417 A * 1/1954 Harsch ..... F15B 15/16 52/114
2,932,597 A * 4/1960 St John ..... F16C 33/20 156/247
(Continued)

FOREIGN PATENT DOCUMENTS

CN 104603379 A * 5/2015 ..... B29C 70/24
CN 105226875 A 1/2016
(Continued)

OTHER PUBLICATIONS

Search Report, dated Jul. 31, 2020, for International Application No. PCT/KR2020/005882.
(Continued)

*Primary Examiner* — Brent W Herring
(74) *Attorney, Agent, or Firm* — LRK Patent Law Firm

(57) ABSTRACT

A telescopic mast includes: a tubular main body in which a power supply signal wire is embedded; one or more tubular sections coupled to be withdrawn from or insertable into the tubular main body; one or more coupling members which are provided at the top ends of the tubular main body and the tubular sections to fix or release the coupling between the tubular main body and the tubular sections during a withdrawn or insertion operation of the tubular sections; and a power supply coupling member which is connected to the power supply signal wire embedded in the tubular main body to supply power thereto.

8 Claims, 10 Drawing Sheets

(51) Int. Cl.
*F21V 21/22* (2006.01)
*H01Q 1/10* (2006.01)

(58) Field of Classification Search
USPC ..... 52/111, 118
See application file for complete search history.

(56) References Cited

U.S. PATENT DOCUMENTS

| | | | | |
|---|---|---|---|---|
| 2,945,638 | A * | 7/1960 | Crawford | B31C 11/04 156/190 |
| 3,323,962 | A * | 6/1967 | Sprengling | B29D 23/001 156/330 |
| 4,013,102 | A * | 3/1977 | DeLorean | F16L 59/027 138/132 |
| 5,035,094 | A | 7/1991 | Legare | |
| 5,591,291 | A | 1/1997 | Blackmore | |
| 5,781,867 | A * | 7/1998 | Tidwell | H01Q 1/08 343/702 |
| 6,274,230 | B1 * | 8/2001 | Sarrelongue | B29C 67/0007 428/377 |
| 6,767,115 | B2 * | 7/2004 | Blackwelder | F21V 21/22 362/418 |
| 10,801,229 | B1 * | 10/2020 | George, Sr. | E04H 12/32 |
| 2003/0095411 | A1 * | 5/2003 | Blackwelder | F21V 21/22 362/418 |
| 2009/0145056 | A1 * | 6/2009 | Pereira | E04H 12/182 52/111 |
| 2010/0146873 | A1 * | 6/2010 | Keller | H01Q 1/10 52/111 |
| 2016/0222688 | A1 * | 8/2016 | McMahon | E04H 12/182 |
| 2016/0271465 | A1 * | 9/2016 | Mordasini | B29C 53/60 |
| 2021/0095492 | A1 * | 4/2021 | Falck-Schmidt | E04H 12/182 |

FOREIGN PATENT DOCUMENTS

| | | | | |
|---|---|---|---|---|
| EP | 0117703 | A2 * | 2/1984 | H01Q 9/30 |
| EP | 0322979 | A2 * | 12/1988 | B29C 70/202 |
| EP | 1621322 | B1 * | 2/2011 | A01K 87/00 |
| JP | H06-010538 | A | 1/1994 | |
| JP | H06-158913 | A | 6/1994 | |
| JP | 2565081 | B2 | 12/1996 | |
| KR | 20110084649 | A * | 1/2010 | H01Q 1/1242 |
| KR | 10-1794299 | B1 | 11/2017 | |
| WO | WO-9745891 | A1 * | 12/1997 | H01Q 1/08 |
| WO | WO-0022334 | A1 * | 4/2000 | B29C 65/20 |
| WO | 2008/125110 | A2 | 10/2008 | |
| WO | WO-2008125110 | A2 * | 10/2008 | E04H 12/182 |
| WO | WO-2009058241 | A2 * | 5/2009 | E04H 12/00 |
| WO | WO-2013064278 | A1 * | 5/2013 | H02G 3/0462 |
| WO | 2018/157209 | A1 | 9/2018 | |
| WO | WO-2020259951 | A1 * | 12/2020 | A63B 60/00 |

OTHER PUBLICATIONS

Written Opinion, dated Jul. 31, 2020, for International Application No. PCT/KR2020/005882.

SIPO Office Action, dated Feb. 14, 2022, for Chinese Patent Application No. 202080030369.0 which corresponds to the above-identified U.S. application.

European Search Repod, dated Mar. 22, 2022, for European Patent Application No. 20810299.6 which corresponds to the above-identified U.S. application.

* cited by examiner

TELESCOPIC MAST

CROSS-REFERENCE TO RELATED APPLICATIONS

The present application is a U.S. National Phase entry from International Application No. PCT/KR2020/005882, filed on May 4, 2020, which claims priority to Korean Patent Application No. 10-2019-0060738, filed on May 23, 2019, the disclosure of which is incorporated by reference herein in their entirety.

TECHNICAL FIELD

The present invention relates to a telescopic mast, and more specifically, to a telescopic mast embedded with a power signal line exposed to the outside and capable of easily setting the entire length of the mast.

BACKGROUND ART

Generally, a telescopic mast is a device that extends the observation range of facilities including a monitoring sensor such as a video camera, a communication device such as an antenna, a lighting device and the like or improves communication performance by raising the facilities as high as 5 to 20 m while the facilities are mounted.

Such a telescopic mast is a device provided with cylindrical sections of different outer diameter values and collars connecting the sections, and capable of extending and contracting the entire length through various driving methods such as driving using a steel strip, driving using air pressure, driving using a belt rope, driving using a wire, driving using ball screws/nuts, driving using rack and pinion gears, and the like.

Meanwhile, in order to use the driving methods described above, a power supply for supplying power to each component (e.g., motor) should be provided in addition to the telescopic mast device, and as a corresponding power supply is provided in addition to the telescopic mast, a power signal line for driving the power supply and the motor should also be provided on the outer surface of the telescopic mast.

That is, in the conventional telescopic mast, the power signal line is exposed to the external environment, and as the outer skin is rapidly deteriorated due to long exposure, damage is caused while using the telescopic mast. That is, as the power signal line is damaged, the risk of generating an electrical accident increases due to poor insulation or disconnection.

In addition, since a user manually adjusts the entire height of the conventional telescopic mast by seeing a numerical figure displayed in a section with naked eyes while power is supplied to the power supply in order to extend or contract all the sections to a length that meets the user's needs, there is a problem in that accuracy and stability are lowered.

Accordingly, it is required to develop a telescopic mast that can absolutely stop the entire length to be appropriate to a standard, together with a safe power line connection method that does not damage the power signal line, and the present invention relates thereto.

DISCLOSURE OF INVENTION

Technical Problem

An object of the present invention is to provide a telescopic mast with a power signal line embedded in a tubular main body so that the power signal line may not be damaged even when the external environment changes.

Another object of the present invention is to provide a telescopic mast that is stopped after the entire height is extended or contracted to a preset height by controlling the final length of drawing out a plurality of sections only by supplying power.

The technical problems of the present invention are not limited to those mentioned above, and unmentioned other technical problems will be clearly understood by those skilled in the art from the following description.

Technical Solution

To accomplish the above objects, according to one aspect of the present invention, there is provided a telescopic mast comprising: a tubular main body embedded with a power signal line; one or more tubular sections coupled to the tubular main body, to be drawn out or drawn in; one or more coupling members provided at top portions of the tubular main body and the tubular sections to fix or release the coupling between the tubular main body and the tubular sections when a draw-in or draw-out operation of the tubular sections is performed; and a power supply coupling member connected to the power signal line embedded in the tubular main body to supply power.

According to an embodiment, the tubular main body may include a first frame made of a composite material wound to have a first diameter in a length direction, and a second frame made of a composite material wound to have a second diameter in a length direction on the first frame, and the power signal line may be embedded to be parallel in the length direction between the first frame and the second frame.

According to an embodiment, the tubular main body may have a thickness of 2.0 to 3.0 mm including the first and second frames.

According to an embodiment, the telescopic mast may further comprise a switch for controlling operation of the power supply coupling member as a tubular section adjacent to the tubular main body is drawn out, wherein the switch may be embedded in a coupling member disposed at a top portion of the tubular main body.

According to an embodiment, the switch may be a magnetic switch electrically connected to the power signal line, and the tubular section adjacent to the tubular main body may further include a guide unit corresponding to a position of the magnetic switch and parallel in the length direction on an outer surface, and a magnetic body disposed at a point of the guide unit to generate a magnetic field for driving the magnetic switch.

According to an embodiment, the magnetic body may be disposed at a bottom portion of the tubular section adjacent to the tubular main body.

According to an embodiment, the power supply coupling member may be detachably coupled on an outer surface of the tubular main body.

According to an embodiment, the one or more tubular sections may be drawn out or drawn in by means of any one among a chain, a belt, and a rope when power is supplied by the power supply coupling member.

According to an embodiment, the composite material may include at least one composite material selected from a group of composite materials prepared by mixing glass fiber, carbon fiber, aramid fiber or polymer fiber with resin.

Advantageous Effects

According to the present invention, since a power signal line is embedded in the process of manufacturing a tubular main body constituting the main body of a telescopic mast using a composite material of high strength, the power signal line may be prevented from being damaged by an external environment as the power signal line is not exposed to the outside.

In addition, as a magnetic switch is embedded in a coupling member connecting the tubular main body and a tubular section and a magnetic body is disposed at a position on the outer surface of the tubular section, the length of drawing out a plurality of sections may be automatically controlled to a final height desired by a user.

The effects of the present invention are not limited to those mentioned above, and unmentioned other effects will be clearly understood by those skilled in the art from the following description.

DESCRIPTION OF SYMBOLS

Figure 1:
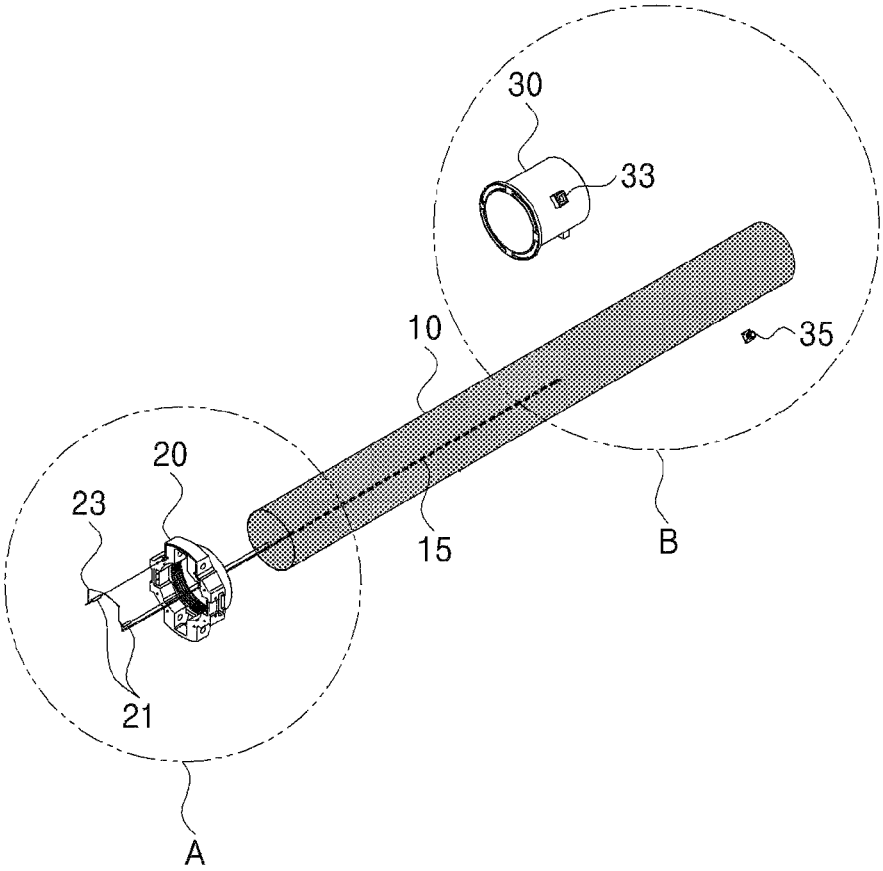
FIG. 1 is an exploded perspective view showing a tubular main body according to an embodiment of the present invention.

1: Mandrel
1000: Telescopic mast
10: Tubular main body
15: Power signal line
20: Coupling member
21: Magnetic switch
23: Switch connection line
30: Power supply coupling member
33: Power signal line connection terminal fixing unit
35: Power signal line connection terminal
40: Tubular section
43: Guide unit
45: Magnetic body

BEST MODE FOR CARRYING OUT THE INVENTION

Hereinafter, preferred embodiments of the present invention will be described in detail with reference to the accompanying drawings in order to clarify the technical spirit of the present invention. In describing the present invention, when it is determined that a detailed description of a related well-known function or component may unnecessarily obscure the gist of the present invention, the detailed description will be omitted. Components having practically the same functional configuration in the drawings are assigned with the same reference numerals and symbols as much as possible although they are shown in different drawings. For convenience of explanation, devices and methods will be described together when needed.

FIG. 1 is an exploded perspective view showing a tubular main body 10 according to an embodiment of the present invention.

Referring to FIG. 1, it may be confirmed that a tubular main body 10 is a main body that functions as the core of a telescopic mast 1000, and a power signal line 15 for receiving power is embedded therein.

More specifically, the tubular main body 10 may include the power signal line 15 in the inside that forms the thickness, and include the coupling member 20 at the top portion (the left area in FIG. 1) to connect the tubular main body 10 to one or more tubular sections having a diameter smaller than that of the tubular main body 10.

Here, the power signal line 15 is a signal line for receiving power to draw out one or more tubular sections disposed inside the tubular main body 10, and one end of the power signal line 15 may be connected to a power supply coupling member 30 that can supply power to the telescopic mast 1000, and the other end may be connected to a magnetic switch 21 included in the coupling member 20.

That is, although the power signal line 15 in the prior art is treated as a separate line that is not physically connected to the tubular main body 10 in order to drive the telescopic mast 1000, in the present invention, as the power signal line 15 is disposed in the inside that forms the thickness of the tubular main body 10, the power signal line 15 may be prevented from being damaged by an external environment.

Meanwhile, the tubular main body 10 and the tubular sections constituting the core main body of the telescopic mast 1000 are manufactured with high strength to be prevented from being damaged in an external environment, and should be light-weighted for easy storage and transportation. That is, the tubular main body 10 and the tubular sections should be formed to be thin, and a method of inserting the power signal line 15 inside the tubular main body 10 formed to be thin may be as described below.

FIGS. 2 to 5 are views for explaining a process of manufacturing a tubular main body 10 according to an embodiment of the present invention.

Figure 2:
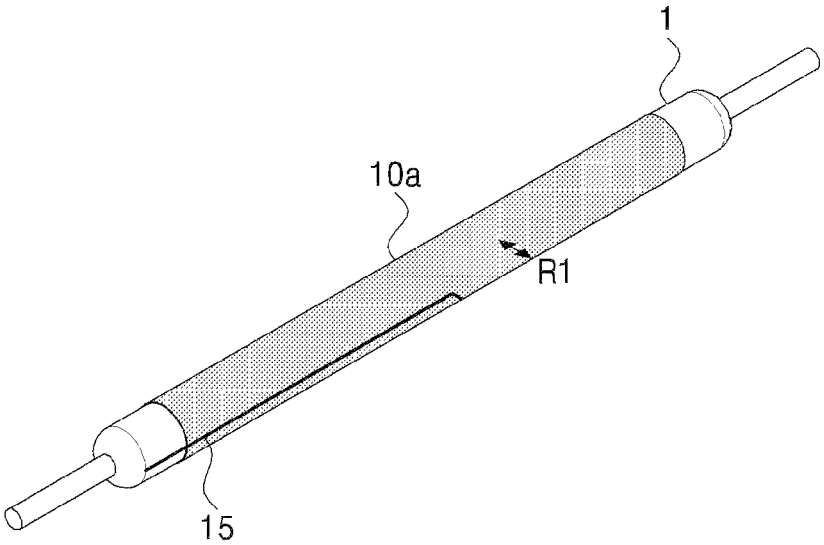
FIGS. 2 to 5 are views for explaining a process of manufacturing a tubular main body according to an embodiment of the present invention.

Referring to FIG. 2, first, a first frame 10*a* is formed on a mandrel 1 having a first diameter R1 by winding a composite material in the length direction in the shape of an oblique line. That is, the first frame 10*a* having an inner diameter equal to the diameter R1 of the mandrel may be formed by winding a composite material until the mandrel 1 is invisible with naked eyes, and the power signal line 15 that is parallel in the length direction of the mandrel 1 is disposed on the first frame 10*a*.

Here, the power signal line 15 is disposed at the center of the first frame 10*a*, one end of which may be disposed to be exposed to the outside of the first frame 10 to be connected to the magnetic switch 21 shown in FIG. 1.

Figure 3:
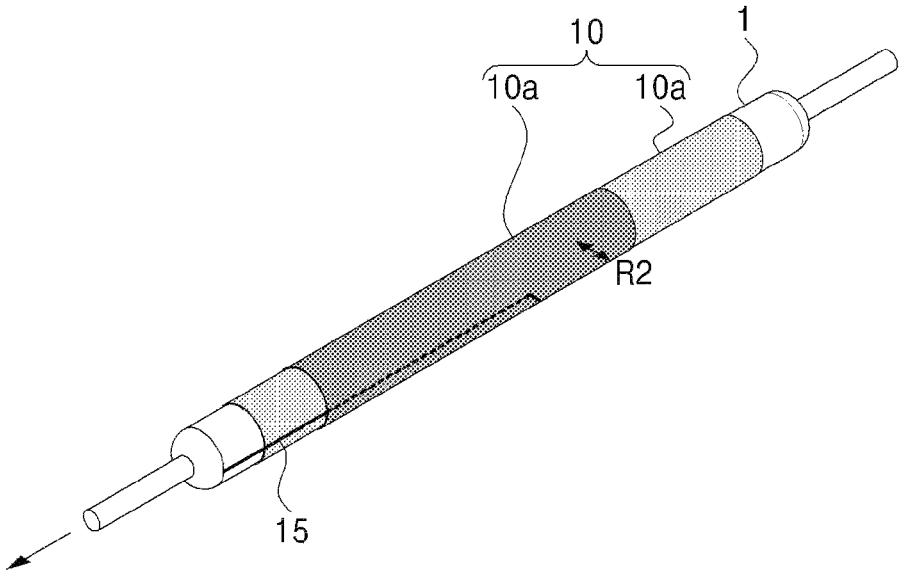

Next, referring to FIG. 3, a second frame 10*b* is formed on the first frame 10*a* on which the power signal line 15 is disposed, by winding a composite material in the length direction in the shape of an oblique line. Here, the first frame 10*a* and the second frame 10*b* may be made of a composite material of the same material. When the second frame 10*b* is completely wound on the first frame 10*a* using a composite material, the first frame 10*a* and the second frame 10*b* may form the single tubular main body 10.

More specifically, the fiber forming the first and second frames 10*a* and 10*b* may include at least one composite material selected from a group of composite materials prepared by mixing glass fiber, carbon fiber, aramid fiber or polymer fiber with resin.

That is, the tubular main body 10 constituting the main body of the telescopic mast 1000 is made of a light-weighted composite material with high strength to improve corrosion resistance and strength of the entire main body and to prevent damage to the power signal line 15 in an external environment.

In addition, the composite material may be wound to tightly contact at regular intervals or without an overlapping area in the process of forming the first and second frames 10*a* and 10*b*, and accordingly, uneven stacking of the first and second frames 10*a* and 10*b* can be prevented, and corrosion resistance and strength of the telescopic mast 1000 can be improved.

Figure 4:
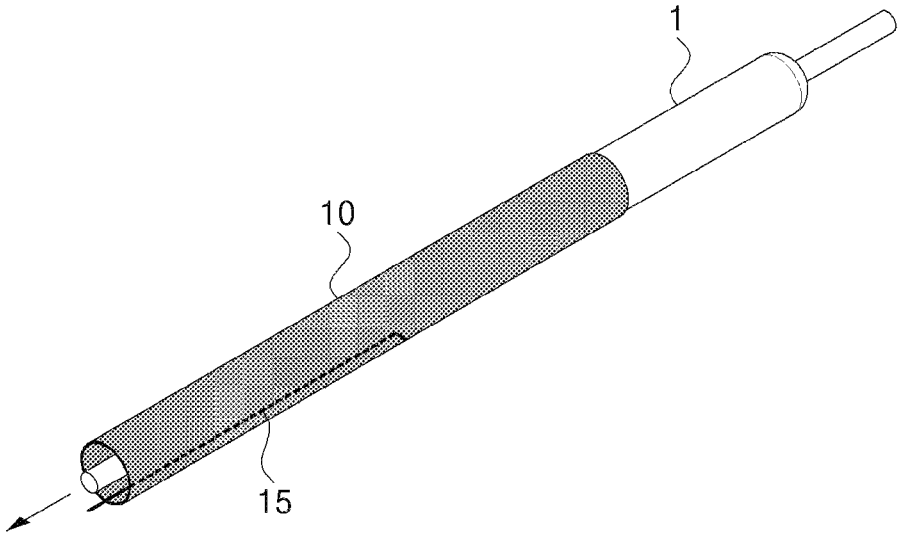

Next, referring to FIG. 4, after the second frame 10*b* is manufactured, the first and second frames 10*a* and 10*b* including the power signal line 15 are completely cured, and after the curing is completed, they are separated from the mandrel 1. That is, the tubular main body 10 made of a composite material including the power signal line 15 may be obtained after the frames are separated.

Figure 5:
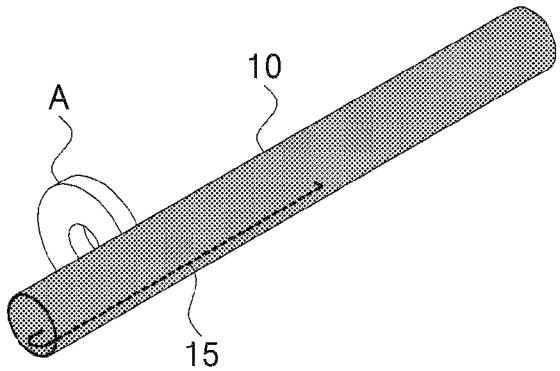

Finally, referring to FIG. 5, the separated tubular main body 10 may be polished using a grinder A to have a thickness of 2.0 to 3.0 mm, and preferably, the tubular main body 10 including the power signal line 15 may be polished to have a thickness of 2.5 mm.

That is, the tubular main body 10 forming the core of the telescopic mast 1000 of the present invention has a very thin thickness of about 2.5 mm and is embedded with the power signal line 15 at the same time, and as wiring connection is simpler than that of a conventional telescopic mast separately provided with a power signal line 15, speedy installation, durability, and convenience and stability of operation can be secured.

Meanwhile, in order to prevent the power signal line 15 from being damaged by the grinder A in the process of polishing the separated tubular main body 10, the partially exposed power signal line 15 may be bent into the inner space of the tubular main body 10.

Referring to FIG. 1 again, the coupling member 20 disposed at the top portion of the tubular main body 10 may be embedded with a switch for controlling the operation of the power supply coupling member 30 as the tubular section adjacent to the tubular main body 10 is drawn out.

Figure 6:
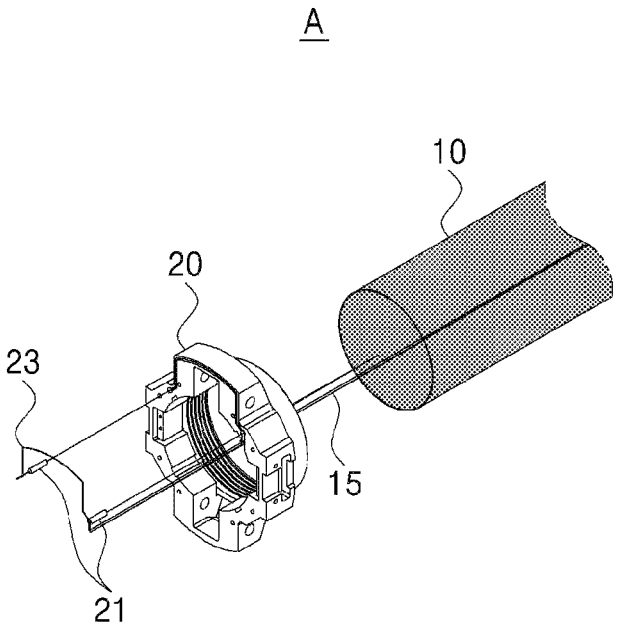
FIG. 6 is an enlarged view showing area A including the coupling member in FIG. 1.

FIG. 6 is an enlarged view showing area A including the coupling member 20 shown in FIG. 1, and referring to FIG. 6, the coupling member 20 coupled to the tubular main body 10 at the top portion of the tubular main body 10 may include a magnetic switch 21 electrically connected to the power signal line 15. More specifically, the coupling member 20 includes two magnetic switches 21 and a switch connection line 23 connecting the magnetic switches, and the two magnetic switches 21 and the power signal line 15 may be connected. Meanwhile, a method of controlling the entire length of the telescopic mast 1000 using the magnetic switch 21 will be described below.

Referring to FIG. 1 again, the telescopic mast may include the power supply coupling member 30 detachably coupled on the outer surface of the tubular main body 10, and the power supply coupling member 30 may include a power signal line connection terminal fixing unit 33 and a power signal line connection terminal 35. However, the elements described above are only an embodiment for easily manufacturing the telescopic mast 1000, and a power source for generating power may be physically coupled to the tubular main body 10.

Figure 7:
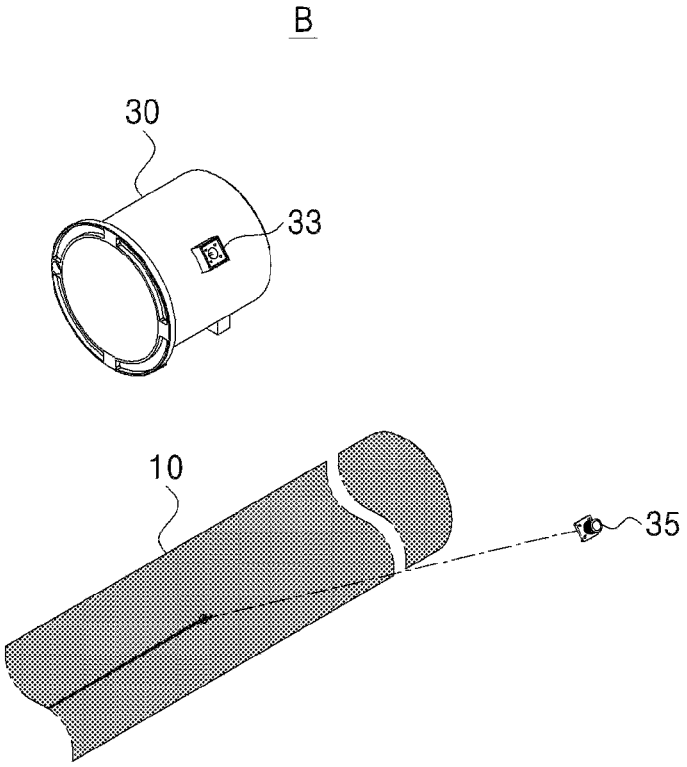
FIG. 7 is an enlarged view showing area B including the power supply coupling member in FIG. 1.

FIG. 7 is an enlarged view showing area B including the power supply coupling member in FIG. 1, and referring to FIG. 7, as the power supply coupling member 30 that receives external power is disposed at the center of the tubular main body 10 and the power signal line connection terminal fixing unit 33 and the power signal line connection terminal 35 are disposed at a point where one end of the power signal line 15 is disposed, corresponding terminals may be connected to the power signal line 15.

Meanwhile, the coupling member 20 and the power supply coupling member 30 may be coupled to the tubular main body 10 in a bonding method, and for example, the coupling may be performed in various bonding methods, such as bonding using an adhesive sheet, bonding using silicone, and the like.

Figure 8:
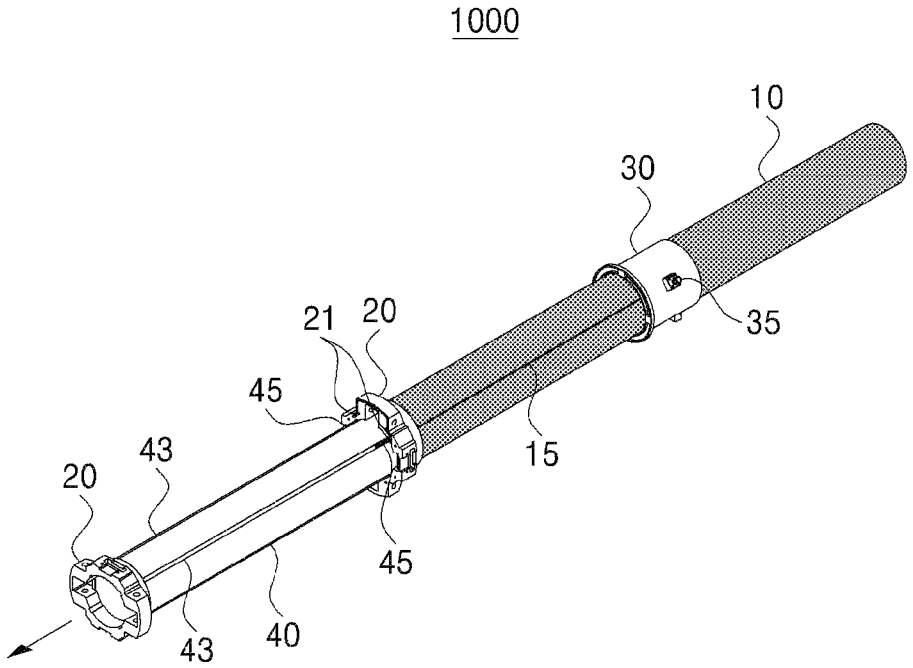
FIG. 8 is a perspective view showing a telescopic mast according to an embodiment of the present invention.
Figure 9:
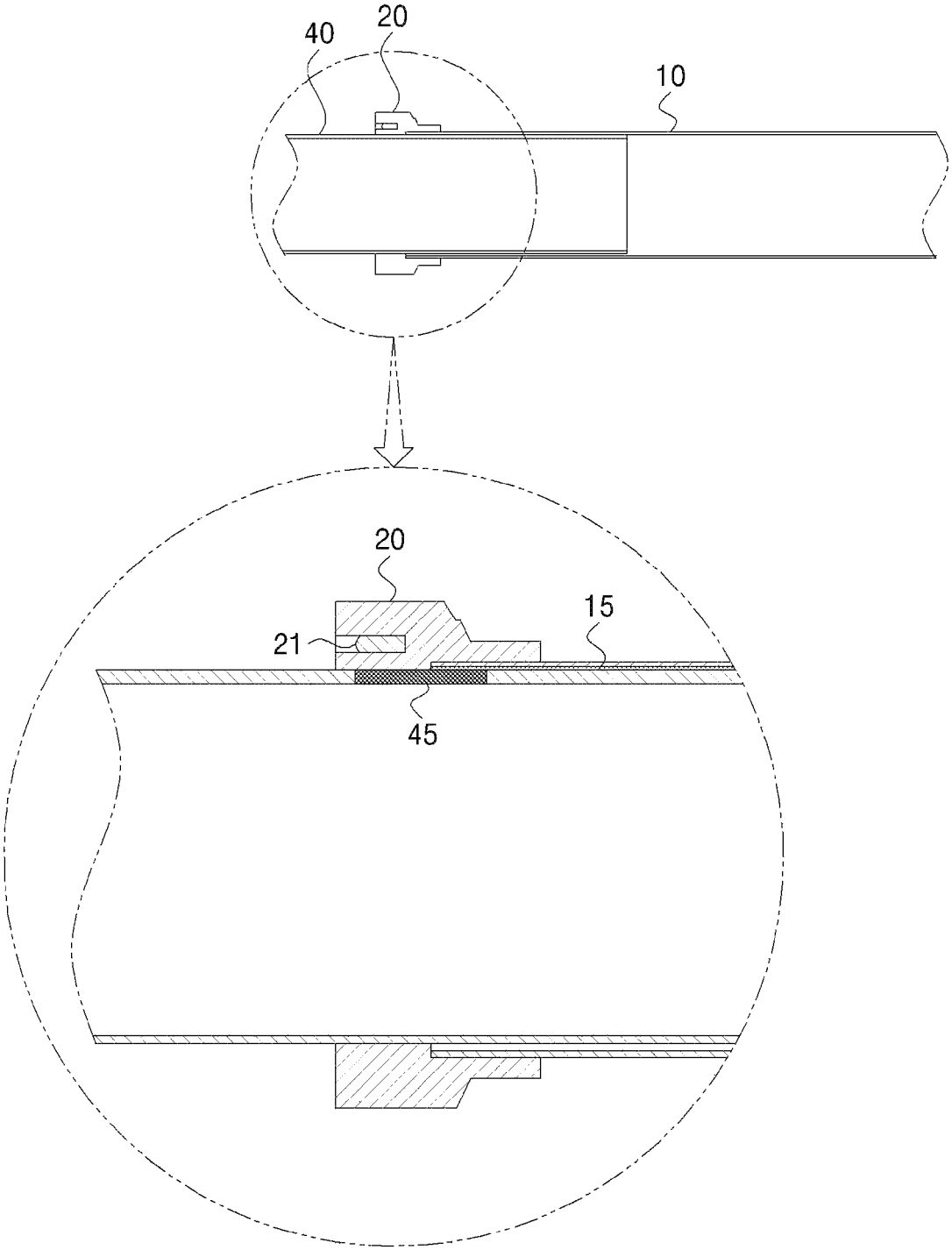
FIG. 9 is a view for explaining a method of setting a length of a telescopic mast according to an embodiment of the present invention.

FIG. 8 is a perspective view showing a telescopic mast 1000 according to an embodiment of the present invention, and FIG. 9 is a view for explaining a method of setting a length of a telescopic mast 1000 according to an embodiment of the present invention.

Referring to FIG. 8, it may be confirmed that coupling members 20 for fixing or releasing coupling with adjacent sections are disposed at the top portions of the tubular main body 10 and the tubular section 40.

More specifically, the operation of fixing or releasing the coupling with the adjacent section may be performed according to the drawing-out or drawing-in operation of the tubular section 40, and to this end, the tubular section 40 closest to the tubular main body 10 may include a guide unit 43 that is parallel in the length direction on the outer surface.

Here, the guide unit 43 may be formed at a point corresponding to the position of the magnetic switch 21, and may perform a function of preventing the rising tubular section 40 from rotating in the circumferential direction.

In addition, the tubular section 40 may include a magnetic body 45 disposed at one point of the guide unit 43 to generate magnetic fields for driving the magnetic switch 21, and the magnetic body 45 may be disposed at the bottom portion of the tubular section 40 adjacent to the tubular main body 10.

Referring to FIG. 9, as the tubular section 40 is drawn out, the magnetic body 45 disposed on the outer surface of the tubular section 40 reaches the point where the magnetic switch 21 disposed at the top portion of the tubular main body 10 is disposed, and as the magnetic switch 21 is operated by the magnetic fields generated by the magnetic body 45, the operation of the power supply coupling member 30 may be stopped. That is, as the operation of the power supply coupling member 30 is stopped, driving of a motor (not shown) connected to the power supply coupling member 30 is stopped, and it may be controlled not to increase the overall length of the telescopic mast 1000 anymore.

As described above, as the length of the telescopic mast 1000 is determined by the magnetic body 45 disposed on the outer surface of the tubular section 40, a user may set a point at which the magnetic body 45 will be disposed in consideration of the length of the tubular main body 10 and one or more tubular sections 40.

Figure 10:
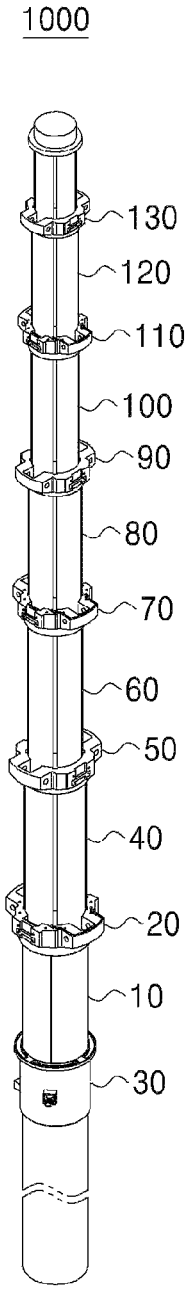
FIG. 10 is a perspective view showing a telescopic mast according to another embodiment of the present invention.

FIG. 10 is a perspective view showing a telescopic mast 1000 according to another embodiment of the present invention.

Referring to FIG. 10, the telescopic mast 1000 may include a tubular main body 10 and a plurality of tubular sections 40, 60, 80, 100, and 120, and each of the tubular sections may be connected through a coupling member 20.

Meanwhile, the plurality of tubular sections 40, 60, 80, 100, and 120 may be drawn out or drawn in by means of any one among a chain, a belt, and a rope when power is supplied by the power supply coupling member 30, and when the tubular sections are coupled in a belt manner, a belt roller (not shown) for supplying a belt to the plurality of tubular sections 40, 60, 80, 100, and 120 may be provided outside the tubular main body 10, and as the plurality of tubular sections 40, 60, 80, 100, and 120 is drawn out, the belt may be fixedly coupled in the length direction.

The telescopic mast 1000 according to an embodiment of the present invention has been described above. According to the present invention, as the telescopic mast 1000 can be drawn out to an accurate height that meets a standard when facilities including a monitoring sensor such as a camera, a communication device such as an antenna, a lighting device and the like perform their function, reliability of the device can be improved. In addition, as the power signal line 15 for supplying power is embedded in the thickness of the thin tubular main body 10, there is an effect of preventing damage to the power signal line 15.

The present invention has been described above in detail with reference to preferred embodiments shown in the drawings. Since these embodiments are not intended to limit the present invention, but merely illustrative, the true technical protection scope of the present invention should be determined by the technical spirit of the appended claims, not by the above description. Although specific terms are used in this specification, they are used only for the purpose of describing the concept of the present invention, and are not used to limit the meaning or scope of the present invention described in the claims.

Each step of the present invention does not need to be performed in the described order, and may be performed in parallel, selectively, or individually. Those skilled in the art will understand that various modifications and equivalent other embodiments are possible without departing from the essential technical spirit of the present invention described in the claims.

The invention claimed is:

1. A telescopic mast comprising:

a tubular main body embedded with a power signal line, wherein the power signal line is disposed in an inside of a thickness part that forms a thickness of the tubular main body;

one or more tubular sections coupled to the tubular main body to be drawn out or drawn in the tubular main body;

one or more coupling members provided at top portions of the tubular main body and the one or more tubular sections to fix or release coupling between the tubular main body and the one or more tubular sections when the drawn-in or drawn-out operation of the one or more tubular sections is performed; and a power supply coupling member connected to the power signal line embedded in the tubular main body to supply power, wherein the tubular main body includes a first frame and a second frame, the first frame made of a composite material and wound to have a first diameter in a length direction, and the second frame made of a composite material and wound on the first frame to have a second diameter in the length direction, and wherein the power signal line is embedded between the first frame and the second frame to be parallel in the length direction.

2. The telescopic mast according to claim 1, wherein the tubular main body including the first and second frames has a thickness of 2.0 to 3.0 mm.

3. The telescopic mast according to claim 1, further comprising a switch for controlling operation of the power supply coupling member as the tubular section adjacent to the tubular main body is drawn out, wherein the switch is embedded in the coupling member disposed at the top portion of the tubular main body.

4. The telescopic mast according to claim 3, wherein:

the switch is a magnetic switch electrically connected to the power signal line, and the tubular section adjacent to the tubular main body includes a guide unit and a magnetic body, the guide unit being provided on an outer surface of the tubular section corresponding to a position of the magnetic switch and parallel in the length direction on the outer surface, and the magnetic body disposed at a point of the guide unit to generate a magnetic field for driving the magnetic switch.

5. The telescopic mast according to claim 4, wherein the magnetic body is disposed at a bottom portion of the tubular section adjacent to the tubular main body.

6. The telescopic mast according to claim 1, wherein the power supply coupling member is detachably coupled on an outer surface of the tubular main body.

7. The telescopic mast according to claim 1, wherein the one or more tubular sections are drawn out or drawn in by means of any one among a chain, a belt, and a rope when power is supplied by the power supply coupling member.

8. The telescopic mast according to claim 1, wherein the composite material includes at least one composite material selected from a group of composite materials prepared by mixing glass fiber, carbon fiber, aramid fiber or polymer fiber with resin.

* * * * *